US006823158B2

(12) United States Patent
Yamada et al.

(10) Patent No.: US 6,823,158 B2
(45) Date of Patent: Nov. 23, 2004

(54) TANDEM STYLE COLOR IMAGE FORMING APPARATUS

(75) Inventors: Takanobu Yamada, Toyokawa (JP); Yuusuke Morikami, Toyohashi (JP); Kyoichi Yoshizawa, Nagoya (JP)

(73) Assignee: Minolta Co., Ltd., Osaka (JP)

( * ) Notice: Subject to any disclaimer, the term of this patent is extended or adjusted under 35 U.S.C. 154(b) by 22 days.

(21) Appl. No.: 10/315,236

(22) Filed: Dec. 10, 2002

(65) Prior Publication Data

US 2003/0108366 A1 Jun. 12, 2003

(30) Foreign Application Priority Data

Dec. 12, 2001 (JP) ..... 2001-378488

(51) Int. Cl.[7] ..... G03G 15/01
(52) U.S. Cl. ..... 399/179; 399/299
(58) Field of Search ..... 399/118, 179, 399/299, 301, 302, 303, 306; 347/116, 118, 138, 152, 232, 245, 263

(56) References Cited

U.S. PATENT DOCUMENTS 3,690,756 A * 9/1972 Smith ..... 399/179
5,243,396 A * 9/1993 Castelli et al. ..... 399/167
5,281,981 A * 1/1994 Kajita ..... 347/116
5,296,897 A * 3/1994 Amemiya et al. ..... 399/39
5,839,040 A * 11/1998 Kagayama et al. ..... 399/302
6,356,718 B1 * 3/2002 Matsumoto ..... 399/40
6,389,260 B1 * 5/2002 Kataoka et al. ..... 399/298
6,539,194 B2 * 3/2003 Oikawa ..... 399/299

FOREIGN PATENT DOCUMENTS

JP 10-288898 10/1998
JP 2000137359 A * 5/2000 ..... G03G/15/01
JP 2001051472 A * 2/2001 ..... G03G/15/01
JP 2001146335 A * 5/2001 ..... B65H/5/02

* cited by examiner

*Primary Examiner*—Robert Beatty
(74) *Attorney, Agent, or Firm*—Morrison & Foerster LLP

(57) ABSTRACT

In an image forming apparatus in which multiple photoconductors for corresponding developers of different colors are disposed along a transfer belt or paper conveyance belt, the photoconductors are disposed at intervals that are each an integer multiple of the outer circumference length of the driving roller that drives the transfer belt or paper conveyance belt, and the distance between at least one pair of photoconductors is made different from the distances between the other pairs of photoconductors. As a result, in comparison with when all of the photoconductors are disposed at equal intervals, the degree of freedom in arranging the multiple image forming units that each include an photoconductor can be increased, while color shift among the developed images of the difference colors on the transfer belt or the like is prevented.

17 Claims, 3 Drawing Sheets

PRIOR ART

TANDEM STYLE COLOR IMAGE FORMING APPARATUS

The present application claims priority to Japanese Patent Application No. 2001-378488 filed Dec. 12, 2001, the entire content of which is hereby incorporated by reference.

BACKGROUND OF THE INVENTION

1. Field of the Invention

The present invention relates to a tandem-style color image forming apparatus.

2. Description of the Related Art

A tandem-style color image forming apparatus 50 like the one shown in FIG. 5 is known in the conventional art. This image forming apparatus 50 includes an intermediate transfer belt 56 that is suspended over a driving roller 52 and a driven roller 54 and is driven to rotate in the direction of the arrow A.

Four image forming units 60Y, 60M, 60C and 60K that respectively correspond to yellow (Y), magenta (M), cyan (C) and black (K) are aligned under the intermediate transfer belt 56. The image forming units 60Y, 60M, 60C and 60K each have a cylindrical photoconductor 62 that is in contact with or close to the intermediate transfer belt 56. They also each have a developing device (not shown) that develops the electrostatic latent image formed on the surface of the photoconductor 62 into a toner image using yellow toner, magenta toner, cyan toner or black toner.

An optical system 64 is disposed under the image forming units 60Y, 60M, 60C and 60K. The optical system 64 comprises a laser exposure device 66, multiple mirrors 68, etc. Each photoconductor 62, which has been uniformly charged, is exposed via laser by this optical system 64, and consequently an electrostatic latent image is formed on the surface of each photoconductor 62.

The electrostatic latent image formed on the surface of each photoconductor 62 is developed by each developing device into a toner image. The toner images of each color respectively formed on each photoconductor 62 then undergo primary transfer in which they are sequentially overlapped onto the intermediate transfer belt 56. The four color toner images transferred onto the intermediate transfer belt 56 are conveyed to the nip area between the intermediate transfer belt 56 and the transfer roller 58, and are then transferred together at a nip area onto a sheet of paper that is being conveyed in the direction of the arrow B, based on the operation of the transfer roller 58.

In the image forming apparatus 50 having this construction, a low-frequency speed fluctuation occurs in the intermediate transfer belt 56 due to vibration that occurs when the driving roller 52 rotates. If the toner images of each color formed by the image forming units 60Y, 60M, 60C and 60K are transferred to the intermediate transfer belt 56 without taking into consideration this speed fluctuation, the positions at which the toner images of each color are transferred become misaligned from each other, resulting in a color shift.

In order to prevent color shift attributable to speed fluctuation in the intermediate transfer belt 56, in the tandem-style color image forming apparatus 50, a method that sets the distances between the photoconductors 62 of the image forming units 60Y, 60M, 60C and 60K to a value equal to an integer multiple of the outer circumference length L of the driving roller 52 (1×, for example) is adopted in general. It is known that color shift among the four toner images of the different colors due to the low-frequency speed fluctuation of the intermediate transfer belt 56 can be prevented using this method.

However, where the photoconductors 62 are to be disposed at equal intervals that are each equal to an integer multiple of the outer circumference length of the driving roller 52 between each photoconductor 62, the degree of freedom in arranging the image forming units 60Y, 60M, 60C and 60K becomes restricted, and a dead space 70 is created within the image forming apparatus 50 due to the relationship between the size of the optical system 64 and the space in which the various components are disposed. As a result, the interior space of the apparatus cannot be efficiently used, hindering efforts to reduce the size of the apparatus.

SUMMARY OF THE INVENTION

An object of the present invention is to increase the degree of freedom in the arrangement of the multiple image forming units that each include a photoconductor in comparison with when all of the photoconductors are disposed at equal intervals, while preventing color shift among the developed images of each color on the transfer belt or the like. Another object is to enable efficient use of the interior space of the apparatus in order to enable the apparatus to be reduced in size.

In order to attain these objects, the image forming apparatus of the present invention is an image forming apparatus in which multiple photoconductors that respectively correspond to developers of different colors are disposed along a transfer belt or paper conveyance belt, wherein the photoconductors are disposed at intervals that are each an integer multiple of the outer circumference length of the driving roller that drives the transfer belt or paper conveyance belt, and wherein the distance between at least one pair of photoconductors is made different from the distances between the other pairs of photoconductors.

The colors of the developers (toner) may be yellow, magenta, cyan and black, and the distance between the black photoconductor and the photoconductor adjacent thereto may be made larger than the distances between the yellow, magenta and cyan photoconductors.

The photoconductors may be disposed such that they face each other across the transfer belt or paper conveyance belt.

The colors of the developers may be yellow, magenta, cyan and black, and the image forming unit including the black photoconductor may be made larger than the image forming units including the photoconductors for the other colors.

The distance between at least one pair of photoconductors may be made larger than the distances between the other pairs of photoconductors.

The distance between at least one pair of photoconductors may be made twice as large as the distances between the other pairs of photoconductors.

The distances between each of the other pairs of photoconductors may be made equal to the outer circumference length of the driving roller that drives the transfer belt or paper conveyance belt.

The image forming apparatus may include an optical system that writes images onto the photoconductors, and a part of the optical system may be disposed in the space comprising the distance between photoconductors that is larger than the distances between other photoconductors.

Furthermore, the image forming apparatus of the present invention is an image forming apparatus in which multiple photoconductors that respectively correspond to developers of different colors are disposed along a transfer belt or paper conveyance belt, wherein such image forming apparatus has an optical system that writes images onto the photoconductors, and wherein the distance between at least one pair of photoconductors is made larger than the distances between the other pairs of photoconductors and a part of the optical system is disposed in the space comprising the larger distance.

The photoconductors may be separated from each other by a distance comprising an integral multiple of the outer circumference length of the driving roller that drives the transfer belt or paper conveyance belt.

Furthermore, the image forming apparatus of the present invention is an image forming apparatus in which first through fourth photoconductors that respectively correspond to developers of different colors are disposed along a transfer belt or paper conveyance belt, wherein the first and second photoconductors are separated from each other by a first distance, the third and fourth photoconductors are separated from each other by the first distance, and the second and third photoconductors are separated from each other by a second distance that is different from the first distance.

The first distance and the second distance may each be an integer multiple of the outer circumference length of the driving roller that drives the transfer belt or paper conveyance belt.

The second distance may be twice as large as the first distance.

The image forming apparatus may include an optical system that writes images onto the first through fourth photoconductors, and a part of the optical system may be disposed in the space between the image forming unit including the second photoconductor and the image forming unit including the third photoconductor.

The photoconductors may be disposed such that the first and second photoconductors and the third and fourth photoconductors face each other across the transfer belt or paper conveyance belt.

The image forming apparatus of the present invention is an image forming apparatus in which first through fourth photoconductors that respectively correspond to developers of different colors are disposed along a transfer belt or paper conveyance belt, wherein the first and second photoconductors are separated from each other by a first distance, the second and third photoconductors are separated from each other by the first distance, and the third and fourth photoconductors are separated from each other by a second distance that is different from the first distance.

The first distance and the second distance may each be an integer multiple of the outer circumference length of the driving roller that drives the transfer belt or paper conveyance belt.

The second distance may be twice as large as the first distance.

The colors of the developers may be yellow, magenta, cyan and black, and the fourth photoconductor may be the black photoconductor.

The image forming unit that includes the black photoconductor may be made larger than the image forming units that respectively include the photoconductors for the other colors.

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawings.

DETAILED DESCRIPTION OF THE PREFERRED EMBODIMENTS

Embodiments of the present invention are described below with reference to the accompanying drawings. In FIGS. 1–4, common numbers may be given to common components and repeated description thereof may be omitted.

Figure 1:
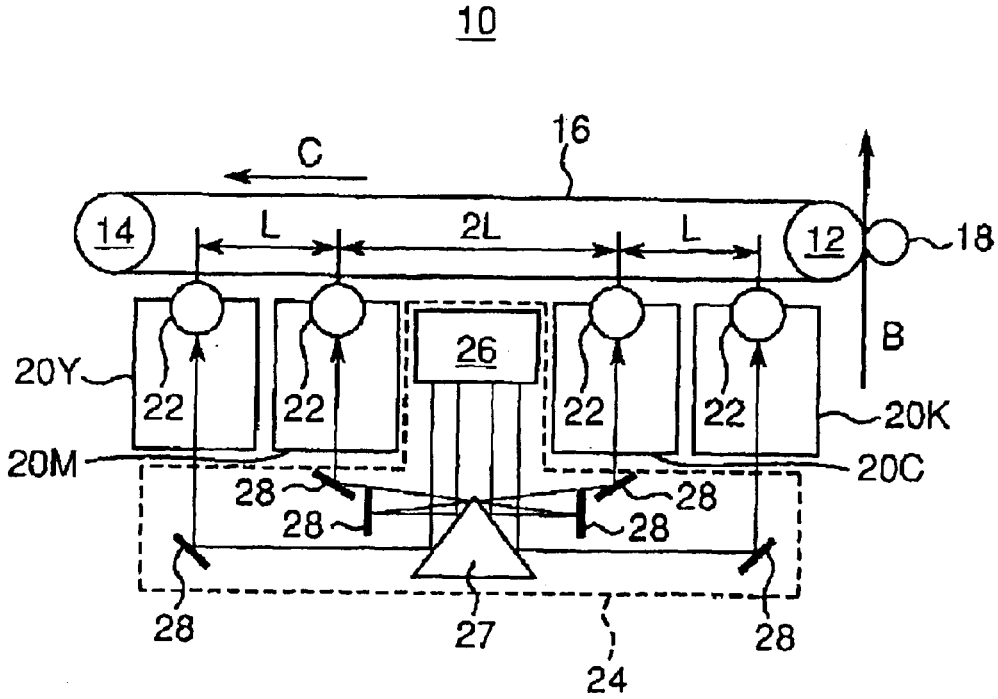
FIG. 1 is a drawing showing the basic construction of an image forming apparatus pertaining to a first embodiment of the present invention.

FIG. 1 is a drawing that shows the basic construction of a tandem-style color image forming apparatus 10 of a first embodiment. The image forming apparatus 10 includes an intermediate transfer belt (transfer belt) 16 that is suspended over a driving roller 12 and a driven roller 14 and is driven to rotate in the direction of the arrow C.

Under the intermediate transfer belt 16, four image forming units 20Y, 20M, 20C and 20K that respectively correspond to toners (developers) of yellow (Y), magenta (M), cyan (C) and black (K) colors are detachably aligned. The image forming units 20Y, 20M, 20C and 20K each have a cylindrical photoconductor 22 that is in contact with or close to the intermediate transfer belt 16. The image forming units 20Y, 20M, 20C and 20K also each have a developing device (not shown) that develops into a toner image the electrostatic latent image formed on the surface of each photoconductor 22 using yellow toner, magenta toner, cyan toner or black toner.

The photoconductors 22 of the image forming unit 20Y, 20M, 20C and 20K are disposed at intervals that are each equal to an integer multiple of the outer circumference length of the driving roller 12 that drives the intermediate transfer belt 16, and at least one such distance is different from the other such distances. This increases the degree of freedom in the arrangement of the image forming units 20Y, 20M, 20C and 20K.

Specifically, where the outer circumference length of the driving roller 12 is deemed L, the distance between the photoconductor 22 of the yellow image forming unit 20Y and the photoconductor 22 of the magenta image forming unit 20M is set to be 1×, for example, of the outer circumference length L of the driving roller 12 (i.e., to L). The distance between the photoconductor 22 of the cyan image forming unit 20C and the photoconductor 22 of the black image forming unit 20K is set to be 1×, for example, of the outer circumference length L of the driving roller 12 (i.e., to L). At the same time, the distance between the photoconductor 22 of the magenta image forming unit 20M and the photoconductor 22 of the cyan image forming unit 20C is set to be 2×, for example, of the outer circumference length L of the driving roller 12 (i.e., to 2L).

By setting the distances between the photoconductors 22 to be an integral multiple of the outer circumference length L of the driving roller 12 that drives the intermediate transfer belt 16 as described above, color shift among the four color toner images on the intermediate transfer belt 16, which is caused by the speed fluctuation of the intermediate transfer belt 16 due to the rotational shake of the driving roller 12, is prevented as described in connection with the conventional art.

In the image forming apparatus 10 of this embodiment, the distances between the photoconductors 22 are not set to be uniformly equal. Instead, as described above, the distance between the magenta photoconductor 22 and the cyan photoconductor 22 is set to be twice as large as the distances between the other pairs of photoconductors. Consequently, a space is created between the magenta image forming unit 20M and the cyan image forming unit 20C. A part of the optical system 24 may be disposed in this space. The optical system 24 comprises a laser exposure device 26 that emits laser beams, a triangular mirror 27, multiple plate-shaped mirrors 28, etc., and the laser exposure device 26 is disposed in the space between the magenta image forming unit 20M and the cyan image forming unit 20C. This optical system 24 exposes each photoconductor 22, which has been uniformly charged, with a laser beam, thereby forming an electrostatic latent image on the surface of each photoconductor 22. In this way, the interior space of the image forming apparatus can be efficiently used without creating a dead space, and the height of the apparatus can be reduced, resulting in a compact apparatus.

The operations of the image forming apparatus 10 of this embodiment will now be explained briefly. Where color mode is activated, the image forming units 20Y, 20M, 20C and 20K operate, whereby toner images of each color are respectively formed on the photoconductors 22 and transferred onto the intermediate transfer belt 16 in an overlapping fashion. The four color toner images transferred onto the intermediate transfer belt 16 in an overlapping fashion are transferred together onto a sheet of paper being conveyed through the nip area between the intermediate transfer belt 16 and the transfer roller 18 and moving in the direction of the arrow B. The sheet of paper is ejected from the apparatus after the four color toner images are fused thereon. On the other hand, where monochrome mode is activated, only the black image forming unit 20K operates, and a black toner image is formed on the photoconductor 22. The black toner image formed on the photoconductor 22 is transferred onto the intermediate transfer belt 16, and then onto a sheet of paper by the transfer roller 18. The sheet of paper is then ejected from the apparatus after the black toner image is fused thereon.

As described above, in the image forming apparatus 10 of this embodiment, the photoconductors 22 are disposed at intervals that are each an integer multiple of the outer circumference length of the driving roller 12 that drives the intermediate transfer belt 16. As a result, color shift among the toner images of the different colors on the intermediate transfer belt 16 can be prevented. In addition, because the distance between the magenta photoconductor 22 and the cyan photoconductor 22 is made larger than the distances between the other pairs of photoconductors, in comparison with when all of the photoconductors 22 are disposed at equal intervals, the degree of freedom in arranging the four image forming units 20Y, 20M, 20C and 20K that each include a photoconductor 22 can be increased. As a result, the interior space of the apparatus can be efficiently used, enabling the size of the apparatus to be reduced.

Figure 2:
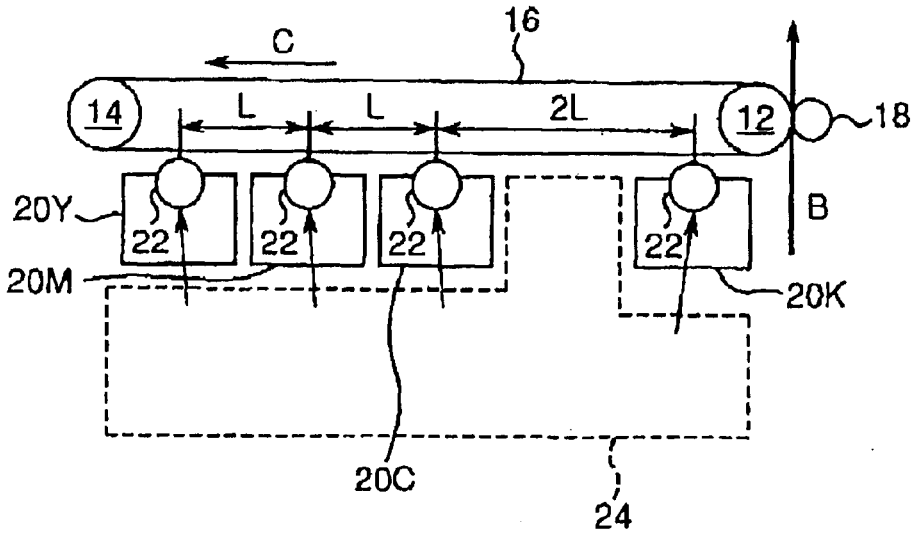
FIG. 2 is a drawing showing the basic construction of an image forming apparatus pertaining to a second embodiment of the present invention.

The image forming apparatus 30 of a second embodiment will now be described with reference to FIG. 2. In this image forming apparatus 30, the yellow, magenta and cyan photoconductors 22 are disposed at equal intervals L that are an integer multiple, such as 1× for example, of the outer circumference length L of the driving roller 12. At the same time, the black photoconductor 22 and the cyan photoconductor 22 adjacent thereto are separated from each other by a distance 2L, which is an integer multiple (2×) of the outer circumference length L of the driving roller 12. By setting the distance between the cyan and black photoconductors 22 to be larger than the distances between the other pairs of photoconductors in this way, a space is created between the cyan image forming unit 20C and the black image forming unit 20K. A part of the optical system 24 is disposed in this space. Because the other components and the image forming operation of this embodiment are the same as those described in connection with the image forming apparatus 10 of the first embodiment, they will not be explained again.

According to the image forming apparatus 30 of this embodiment, the same effect as the image forming apparatus 10 of the first embodiment is obtained, and furthermore because the yellow, cyan and magenta image forming units 20Y, 20M and 20C, which comprise color image forming units, can be grouped together and replaced as a single integrated unit, operability during component replacement can be improved.

Figure 3:
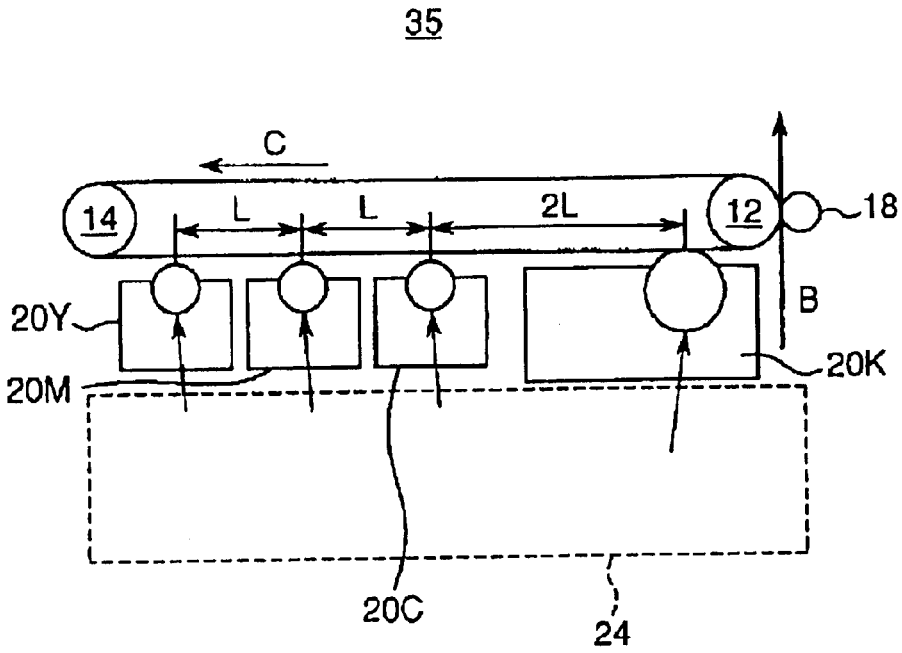
FIG. 3 is a drawing showing the basic construction of an image forming apparatus pertaining to a third embodiment of the present invention.

The image forming apparatus 35 of a third embodiment will now be described with reference to FIG. 3. In this image forming apparatus 35, the yellow, magenta and cyan photoconductors 22 are equally separated from one another by a distance L, which is an integer multiple, such as 1× for example, of the outer circumference length L of the driving roller 12, as in the image forming apparatus 30 of the second embodiment. At the same time, the distance between the black photoconductor 22 and the cyan photoconductor 22, which is adjacent to the black photoconductor 22, is set to be a distance 2L, which is an integer multiple, such as 2× for example, of the outer circumference length L of the driving roller 12. By setting the distance between the cyan photoconductor 22 and the black photoconductor 22 to be larger than the distances between the other pairs of photoconductors in this way, the black image forming unit 20K can be made larger than the other image forming units 20Y, 20M or 20C. As a result, a larger amount of black toner can be housed therein, resulting in fewer replacements of the black image forming unit 20K and lower printing costs per sheet in monochrome mode. Because this embodiment has essentially the identical components and image forming operation as the other embodiments described above, such components and operation will not be described once more here.

Figure 4:
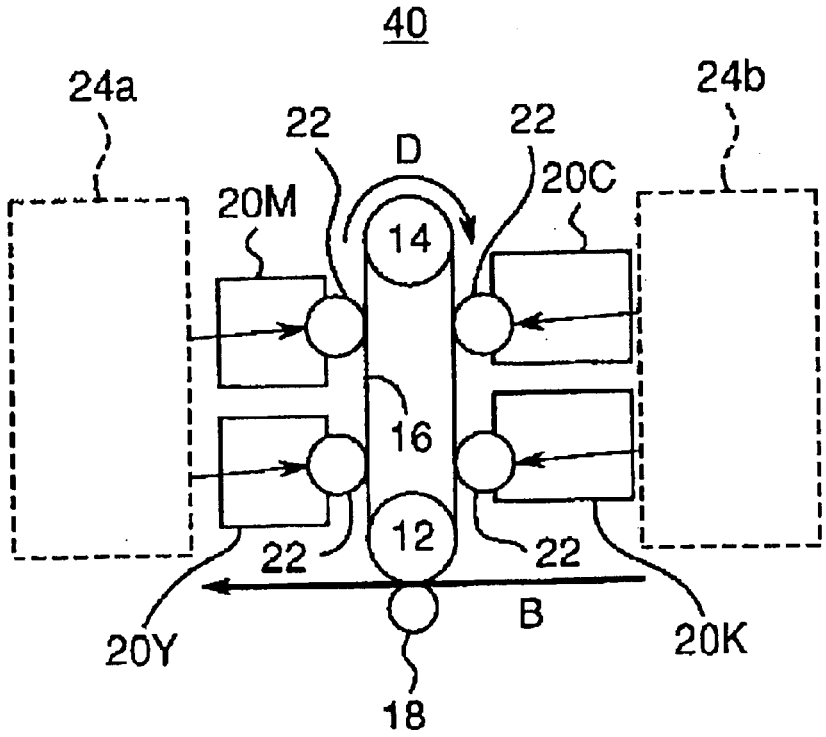
FIG. 4 is a drawing showing the basic construction of an image forming apparatus pertaining to a fourth embodiment of the present invention.
Figure 5:
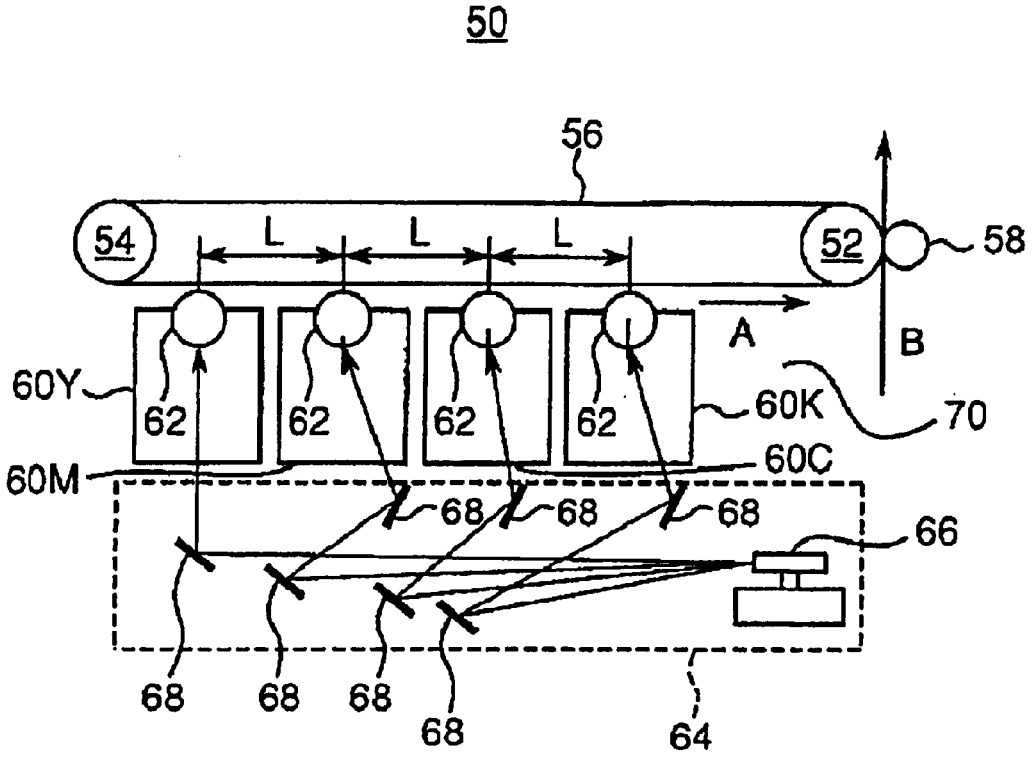
FIG. 5 is a drawing showing the basic construction of an image forming apparatus of the conventional art.

The image forming apparatus 40 of a fourth embodiment will now be described with reference to FIG. 4. In this image forming apparatus 40, the intermediate transfer belt 16 is disposed such that it is rotated vertically in the direction of the arrow E by the driving roller 12. A group comprising the yellow image forming unit 20Y and the magenta image forming unit 20M and a group comprising the cyan image forming unit 20C and the black image forming unit 20K are disposed such that they face each other across the intermediate transfer belt 16. Two corresponding optical systems 24*a* and 24*b* are disposed on either side of the intermediate transfer belt 16.

In this case, the distance between the yellow photoconductor 22 and the magenta photoconductor 22 is set to be a distance L, which is an integer multiple, such as 1× for example, of the outer circumference length L of the driving roller 12, and the distance between the cyan photoconductor 22 and the black photoconductor 22 is also set to be a distance L, which is an integer multiple, such as 1× for example, of the outer circumference length L of the driving roller 12. At the same time, the distance between the magenta photoconductor 22 and the cyan photoconductor 22, such distance extending along the intermediate transfer belt 16, is set to be distance 2L, which is an integer multiple, such as 2× for example, of the outer circumference length L of the driving roller 12. Because the image forming apparatus 40 has essentially the same components and image forming operation as the other embodiments described above, they will not be described once more here.

Where the image forming units 20Y, 20M, 20C and 20K are disposed such that they face each other across the intermediate transfer belt 16 in this way, because each distance therebetween is an integer multiple of the outer circumference length of the driving roller 12, while the distance between the photoconductors within one group and the distance between the two groups are not the same, the same effect as the image forming apparatus 10 of the first embodiment described above can be obtained. In addition, this embodiment achieves an unprecedented new interior construction in which the image forming units 20Y, 20M, 20C and 20K are disposed such that they face each other across the intermediate transfer belt 16, helping to reduce the size of the apparatus.

Although the image forming apparatuses 10, 20, 35 and 40 that sequentially transfer the different color toner images onto an intermediate transfer belt 16 using image forming units 20Y, 20M, 20C and 20K were described in connection with the above embodiments, the present invention can be applied in image forming apparatuses in which image forming units 20Y, 20M, 20C and 20K are disposed along a paper conveyance belt and sequentially transfer different color toner images onto a sheet of paper being conveyed on the paper conveyance belt.

According to the image forming apparatus of the present invention, because the photoconductors are disposed at equal intervals that are each an integer multiple of the outer circumference length of the driving roller that drives the transfer belt or paper conveyance belt, and the distance between at least one pair of photoconductors is made different from the distances between the other pairs of photoconductors, in comparison with when all of the photoconductors are disposed at equal intervals, the degree of freedom in arranging the multiple image forming units that each include a photoconductor can be increased as color shift among the developed images of the different colors on the transfer belt or the like is prevented, and as a result, the interior space of the apparatus can be efficiently used, enabling the apparatus to be more compact in size.

In the image forming apparatus of the present invention, yellow, magenta, cyan and black image forming units are used, and by making the distance between the black photoconductor and the photoconductor adjacent thereto larger than the distances between the yellow, magenta and cyan photoconductors, a part of the optical system, for example, can be disposed in the space between the image forming unit including the black photoconductor and the image forming unit including the photoconductor adjacent thereto, which enables efficient use of the interior of the apparatus and thus permits the size of the apparatus to be reduced. Furthermore, if the distance between the black photoconductor and the photoconductor adjacent thereto is made larger and the image forming unit including the black photoconductor is made larger than the image forming units for the other colors, the amount of black developer that can be housed in the black image forming unit can be increased, resulting in fewer replacements of the black image forming unit and a reduction in the printing cost per sheet in monochrome mode.

Moreover, in the image forming apparatus of the present invention, if the photoconductors for the different colors are disposed such that they face each other across the transfer belt or paper conveyance belt, an unprecedented new interior arrangement is achieved and a reduction in size of the apparatus can be promoted.

Although the present invention has been fully described by way of examples with reference to the accompanying drawings, it is to be noted that various changes and modifications will be apparent to those skilled in the art. Therefore, unless such changes and modification depart from the scope of the present invention, they should be construed as being included therein.

What is claimed is:

1. An image forming apparatus, comprising:

multiple photoconductors that respectively correspond to developers of different colors are disposed along a transfer belt or paper conveyance belt; and a driving roller which drives the transfer belt or paper conveyance belt;

wherein the photoconductors are disposed at intervals that are each an integer multiple of an outer circumference length of the driving roller; and a distance between at least one pair of photoconductors is made different from distances between the other pairs of photoconductors.

2. The image forming apparatus of claim 1, wherein colors of the developers are yellow, magenta, cyan and black, and the distance between the black photoconductor and the photoconductor adjacent thereto is made larger than the distances between the yellow, magenta and cyan photoconductors.

3. The image forming apparatus of claim 1, wherein the photoconductors are disposed such that they face each other across the transfer belt or paper conveyance belt.

4. The image forming apparatus of claim 1, wherein colors of the developers are yellow, magenta, cyan and black, and an image forming unit including the black photoconductor is made larger than image forming units including the photoconductors for the other colors.

5. The image forming apparatus of claim 1, a distance between at least one pair of photoconductors is made larger than distances between the other pairs of photoconductors.

6. The image forming apparatus of claim 5, wherein the distance between at least one pair of photoconductors is made twice as large as the distances between the other pairs of photoconductors.

7. The image forming apparatus of claim 5, wherein the distances between each of the other pairs of photoconductors are made equal to the outer circumference length of the driving roller.

8. The image forming apparatus of claim 5, further comprising:

an optical system which writes images onto the photoconductors, wherein a part of the optical system is disposed in space comprising the distance between photoconductors that is larger than the distances between other photoconductors.

9. An image forming apparatus, comprising:

multiple photoconductors that respectively correspond to developers of different colors are disposed along a transfer belt or paper conveyance belt; and a driving roller which drives the transfer belt or paper conveyance belt;

an optical system which writes images onto the photoconductors, wherein a distance between at least one pair of photoconductors is made different from distances between the other pairs of photoconductors, a part of the optical system is disposed in space comprising the larger distance, and the photoconductors are disposed at intervals that are each an integer multiple of an outer circumference length of the driving roller.

10. An image forming apparatus, comprising:

first through fourth photoconductors that respectively correspond to developers of different colors are disposed along a transfer belt or paper conveyance belt; and a driving roller which drives the transfer belt or paper conveyance belt, wherein the first and second photoconductors are separated from each other by a first distance, the third and fourth photoconductors are separated from each other by the first distance, and the second and third photoconductors are separated from each other by a second distance that is different from the first distance, and the first distance and the second distance are an integer multiple of an outer circumference length of the driving roller.

11. The image forming apparatus of claim 10, wherein the photoconductors are disposed such that the first and second photoconductors and the third and fourth photoconductors face each other across the transfer belt or paper conveyance belt.

12. An image forming apparatus, comprising:

first through fourth photoconductors that respectively correspond to developers of different colors are disposed along a transfer belt or paper conveyance belt, wherein the first and second photoconductors are separated from each other by a first distance, the third and fourth photoconductors are separated from each other by the first distance, and the second and third photoconductors are separated from each other by a second distance that is different from the first distance, and the second distance is twice as large as the first distance.

13. An image forming apparatus, comprising:

first through fourth photoconducters that respectively correspond to developers of different colors are disposed along a transfer belt or paper conveyance belt; and an optical system which writes images onto the first through fourth photoconductors, wherein the first and second photoconductors are separated from each other by a first distance, the third and fourth photoconductors are separated from each other by the first distance, and the second and third photoconductors are separated from each other by a second distance that is different from the first distance, and a part of the optical system is disposed in space between an image forming unit including the second photoconductor and an image forming unit including the third photoconductor.

14. An image forming apparatus, comprising:

first through fourth photoconductors that respectively correspond to developers of different colors are disposed alone a transfer belt or paper conveyance belt; and a driving roller which drives the transfer belt or paper conveyance belt, wherein the first and second photoconductors are separated from each other by a first distance, the second and third photoconductors are separated from each other by the first distance, and the third and forth photoconductors are separated from each other by a second distance that is different from the first distance, and the first distance and the second distance are an integer multiple of an outer circumference length of the driving roller.

15. The image forming apparatus of claim 14, wherein colors of the developers are yellow, magenta, cyan and black, and the fourth photoconductor is the black photoconductor.

16. The image forming apparatus of claim 15, wherein an image forming unit that includes the black photoconductor is made larger than image forming units that respectively include the photoconductors for the other colors.

17. An image forming apparatus, comprising:

first through fourth photoconductors that respectively correspond to developers of different colors are disposed along a transfer belt or paper conveyance belt, wherein the first and second photoconductors are separated from each other by a first distance, the second and third photoconductors are separated from each other by the first distance, and the third and forth photoconductors are separated from each other by a second distance that is different from the first distance, and the second distance is twice as large as the first distance.

* * * * *

UNITED STATES PATENT AND TRADEMARK OFFICE

CERTIFICATE OF CORRECTION

PATENT NO. : 6,823,158 B2
DATED : November 23, 2004
INVENTOR(S) : Yamada et al.

It is certified that error appears in the above-identified patent and that said Letters Patent is hereby corrected as shown below:

Column 10,
Line 22, replace “alone” with -- along --; and
Lines 29 and 52, replace “forth” with -- fourth --

Signed and Sealed this

Seventh Day of June, 2005

JON W. DUDAS
*Director of the United States Patent and Trademark Office*